US007013957B2

(12) United States Patent
Hsu

(10) Patent No.: US 7,013,957 B2
(45) Date of Patent: Mar. 21, 2006

(54) END SURFACE STRUCTURE OF HEAT PIPE

(76) Inventor: Hul- Chun Hsu, 6F-3, No. 422, Sec. 2, Li-Ming Rd., Taichung (TW)

( * ) Notice: Subject to any disclaimer, the term of this patent is extended or adjusted under 35 U.S.C. 154(b) by 0 days.

(21) Appl. No.: 10/799,655

(22) Filed: Mar. 15, 2004

(65) Prior Publication Data

US 2005/0199375 A1 Sep. 15, 2005

(51) Int. Cl.
*F28D 15/00* (2006.01)

(52) U.S. Cl. ..... 165/104.26; 165/104.21; 165/104.33; 361/700; 257/715; 174/15.2

(58) Field of Classification Search ..... 165/104.21, 165/104.33, 104.26, 80.4, 185; 361/699, 361/700; 257/714–716; 174/15.2
See application file for complete search history.

(56) References Cited

U.S. PATENT DOCUMENTS 5,412,535 A * 5/1995 Chao et al. ..... 361/700
5,582,242 A * 12/1996 Hamburgen et al. ... 165/104.21
5,632,158 A * 5/1997 Tajima ..... 62/259.2
6,725,909 B1 * 4/2004 Luo ..... 165/104.21
6,793,009 B1 * 9/2004 Sarraf ..... 165/104.33
6,827,133 B1 * 12/2004 Luo ..... 165/104.21
2003/0066628 A1 * 4/2003 Mochizuki et al. .... 165/104.26

FOREIGN PATENT DOCUMENTS

JP 60-42593 * 3/1985 ..... 165/104.26

* cited by examiner

*Primary Examiner*—Terrell Mckinnon

(57) ABSTRACT

An end surface structure having a pipe member, a first lid and a second lid is disclosed. The pipe member has two opposing open ends. The first and second lids each has an interlocking member to frictionally fit the first and second lids with the pipe member at the open ends. Each of the first and second lids further has a flange extending outwardly and radially from the interlocking member. The thickness of the flanges is larger than the interior periphery of the open ends but no larger than the exterior periphery of the heat pipe. When the first and second lids are fitted with the heat pipe at the open ends, a welding process is performed to permanently connect the heat pipe with the first and second lids.

9 Claims, 5 Drawing Sheets

END SURFACE STRUCTURE OF HEAT PIPE

BACKGROUND OF THE INVENTION

The present invention relates in general to an end surface structure of a heat pipe, and more particularly, to an end surface structure of a heat pipe that has a large gauge.

Having the characteristics of high thermal conductivity, fast thermal conduction, light weight, non-movable components and simple structure, heat pipes are able to deliver large amount of heat without consuming electricity, and are therefore commonly used in the market.

FIG. 1 illustrates a conventional heat pipe 1*a* with a large gauge. The end surfaces of such heat pipe are difficult to fabricate during tube shrinking process.

Further, as the sealing structure 11*a* of the heat pipe 1*a* is excessively large, such type of heat pipe 1*a* cannot be used in a space with a high density of electronic components. Particularly, the heat conductance at the end surfaces of the heat pipe is typically poorer than other portions of the heat pipe. However, the irregular structure of the end surfaces causes inconvenience of connecting other thermal conducting mechanism such as heat dissipation fins 12*a*.

Therefore, there exist inconvenience and drawbacks for practically application of the above-mentioned conventional heat pipe. There is thus a substantial need to provide an improved end surface structure of heat pipe that resolves the above drawbacks and can be used more conveniently and practically.

SUMMARY OF THE INVENTION

The present invention provides an end surface structure of a heat pipe that can be fabricated by mass production. Further, the end surface will not protrude from the heat pipe because of the sealing structure, such that the volume and space occupied by the heat pipe are effectively reduce.

The end surface structure provided by the present invention includes a pipe member, a first lid and a second lid. The pipe member includes two opposing open ends. The first and second lids each includes an interlocking member to frictionally fit the first and second lids with the pipe member at the open ends. Each of the first and second lids further comprises a flange extending outwardly and radially from the interlocking member. The thickness of the flanges is larger than the interior periphery of the open ends but no larger than the exterior periphery of the heat pipe. When the first and second lids are fitted with the heat pipe at the open ends, a welding process is performed to permanently connect the heat pipe with the first and second lids. As the thickness of the flange is smaller, the flanges are melted first during the welding process. Therefore, the pipe member is prevented from being damaged during the welding process.

These and other objectives of the present invention will become obvious to those of ordinary skill in the art after reading the following detailed description of preferred embodiments.

It is to be understood that both the foregoing general description and the is following detailed description are exemplary, and are intended to provide further explanation of the invention as claimed.

BRIEF DESCRIPTION OF ACCOMPANIED DRAWINGS

The above objects and advantages of the present invention will be become more apparent by describing in detail exemplary embodiments thereof with reference to the attached drawings in which.

DETAILED DESCRIPTION OF EMBODIMENT

Figure 1:
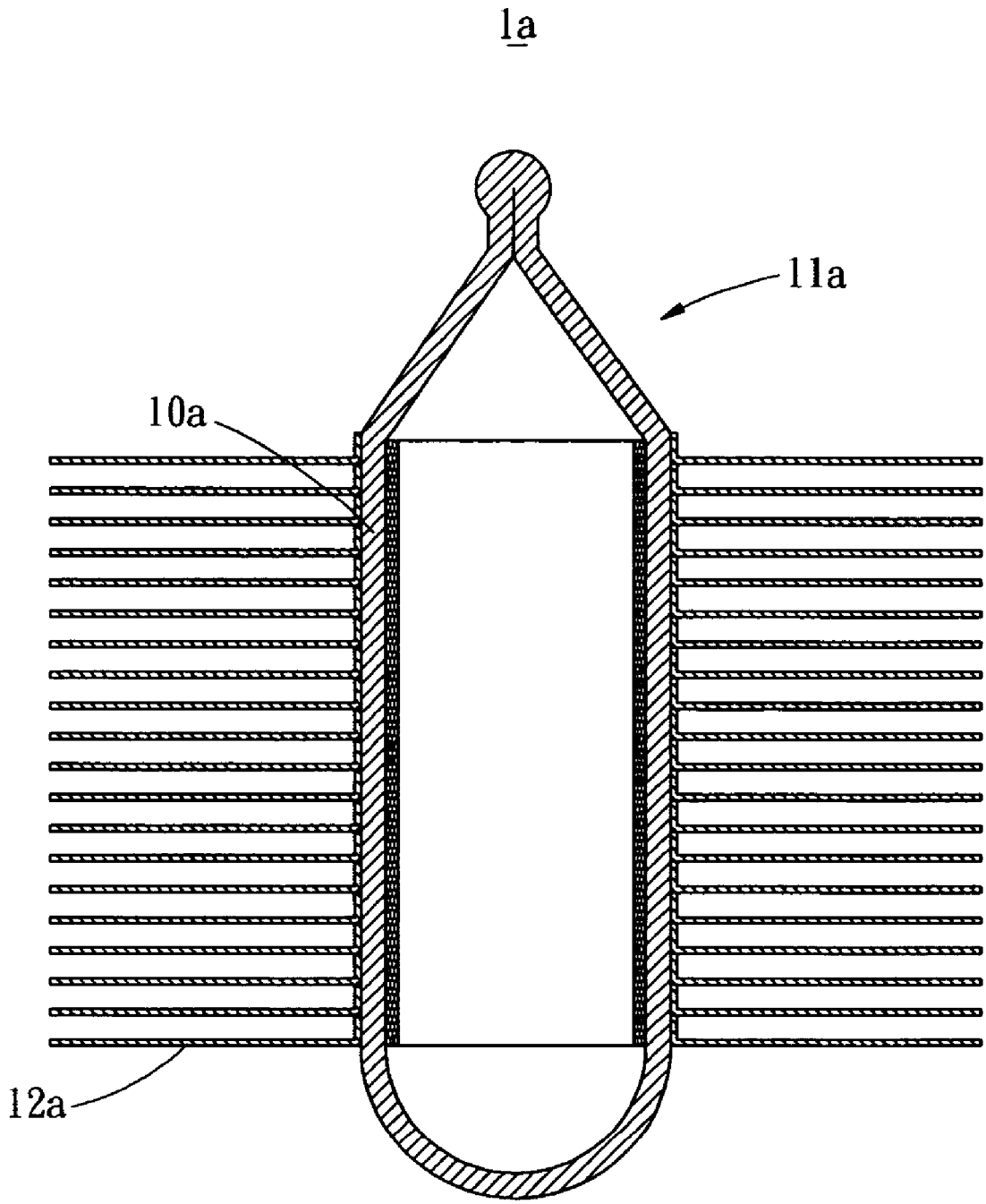
FIG. 1 PRIOR ART
FIG. 1 illustrates a cross sectional view of a conventional heat pipe extending through a set of fins.

Reference will now be made in detail to the preferred embodiments of the present invention, examples of which are illustrated in the accompanying drawings. Wherever possible, the same reference numbers are used in the drawings and the description to refer to the same or like parts.

Figure 2:
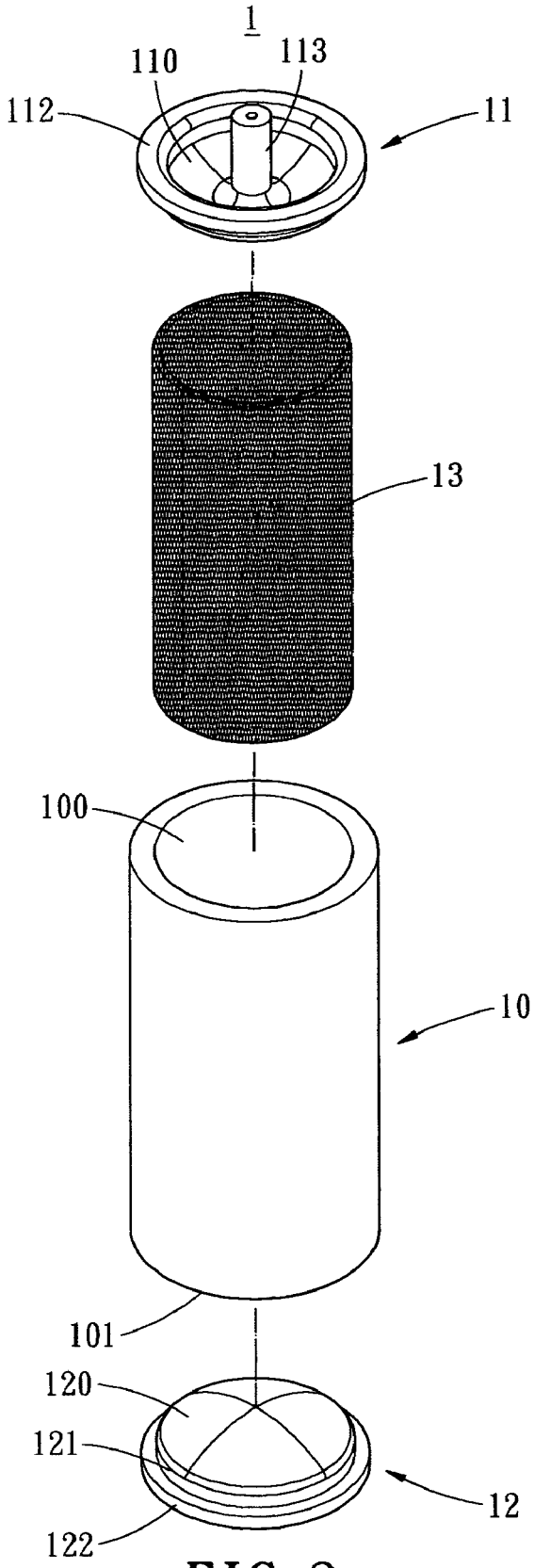
FIG. 2 shows an exploded view of a heat pipe provided by the present invention.
Figure 3:
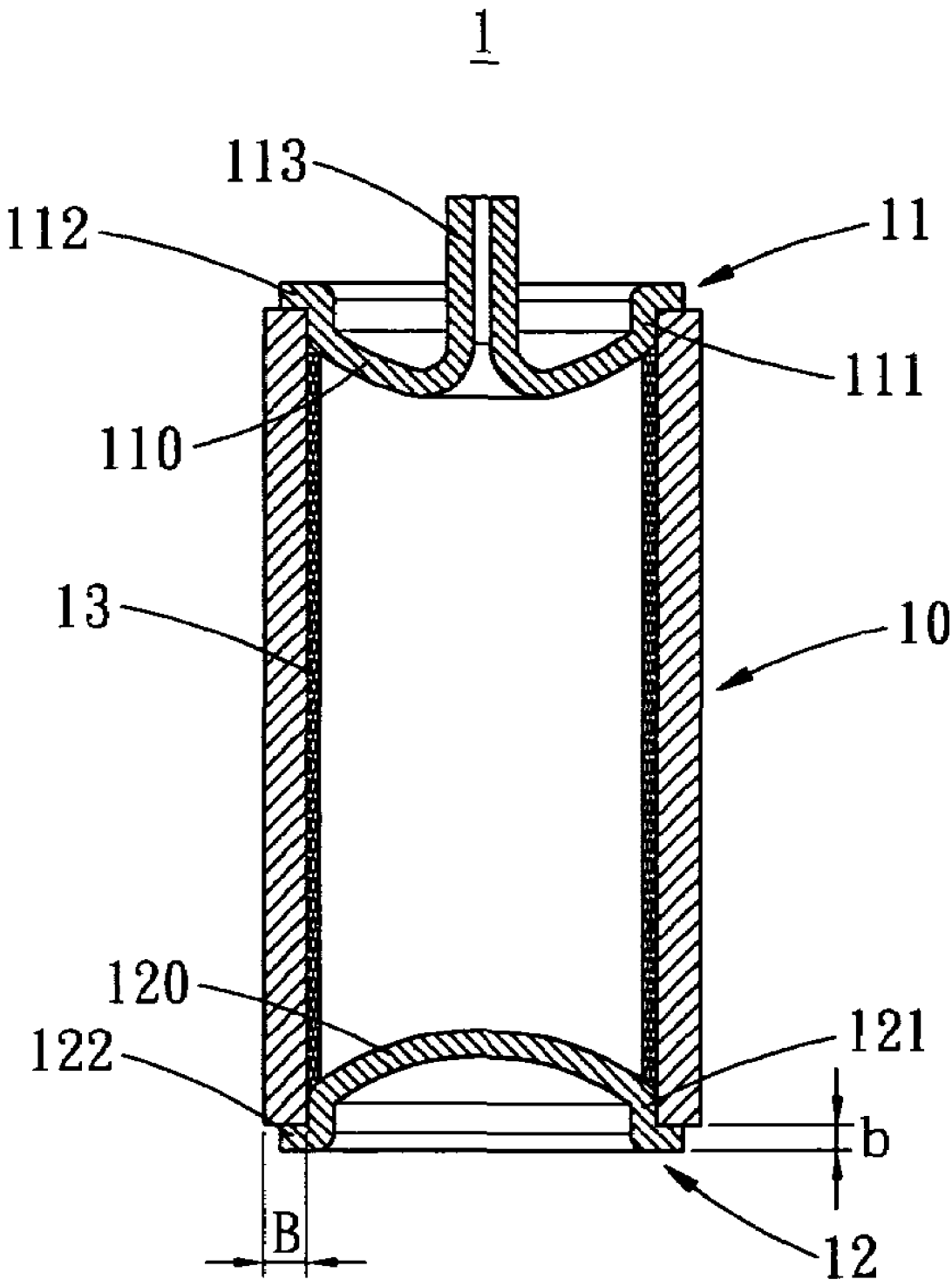
FIG. 3 is cross sectional view of the heat pipe.

As shown in FIGS. 2 and 3, exploded view and cross sectional view of a heat pipe provided by the present invention are illustrated. As shown, the heat pipe includes a pipe member 10, a first lid 11 and a second lid 12.

The pipe member 10 is preferably a cylindrical hollow tube with two open ends 100 and 101. A wick structure 13 is attached to an internal surface of the pipe member 10. The first and second lids 11 and 12 include thin plates fabricated by press, for example. The first and second lids 11 and 12 are applied to seal the pipe member 10 at the open ends 100 and 101, respectively. The first and second lids 11 and 12 each have curved surfaces 110 and 112 to improve mechanical strength, respectively. The curved surfaces 110 and 112 include recessed curved surfaces as shown in FIGS. 2 and 3 or protruding curved surfaces. In addition, the first lid 11 allows a filing tube 113 mounted thereon, such that working fluid can be filled inside of the tube member 10. After some further process such as vacuuming, the pipe member 10 is sealed by a sealing structure 114 (as shown in FIG. 3) by the application of tin or soldering.

The pipe member 10 is permanently connected with the first and second lids 11 and 12 by a welding process for permanently. The first and second lids 11 and 12 include interlocking members 111 and 121 along peripheries thereof, respectively. Extending from the interlocking members 111 and 121 are two flanges 112 and 122 of which the diameters are larger than the interior diameters and smaller than the exterior diameters of the pipe member 10. As the shapes of the interlocking members 111 and 121 are the same as the interior surfaces of the openings 100 and 101, the interlocking members 111 and 121 interlock the first and second lids 11 and 12 with the pipe member 10. Therefore, the interlocking members 111 and 112 position the lids 11 and 12 along the radial direction of the pipe member 10, while the flanges 112 and 122 position the first and second lids 11 and 12 along the axial direction of the pipe member 10. Further, the thickness b of the flanges 112 and 122 is no larger than the thickness B of the wall of the pipe member 10.

Thereby, an end surface structure of a heat pipe is provided.

Figure 4:
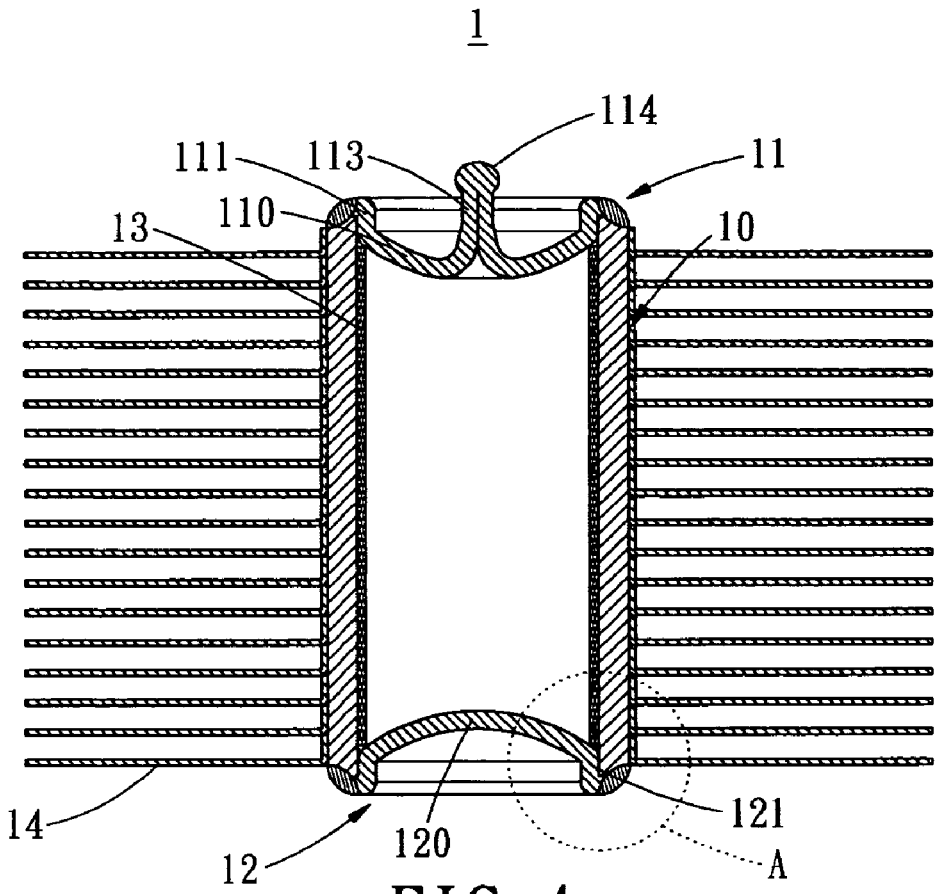
FIG. 4 is a cross sectional view of the heat pipe assembled with a set of fins.
Figure 5:
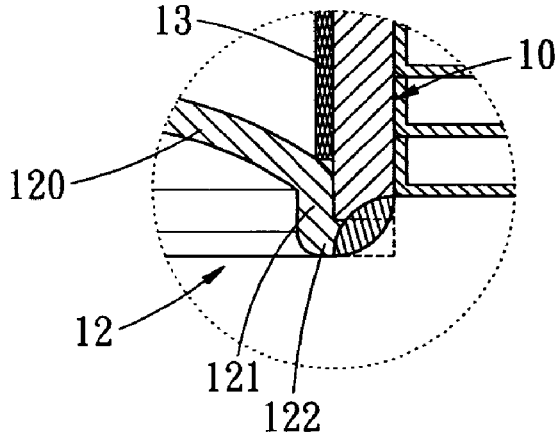
FIG. 5 shows a local enlarged view of the portion A as shown in FIG. 4.
Figure 6:
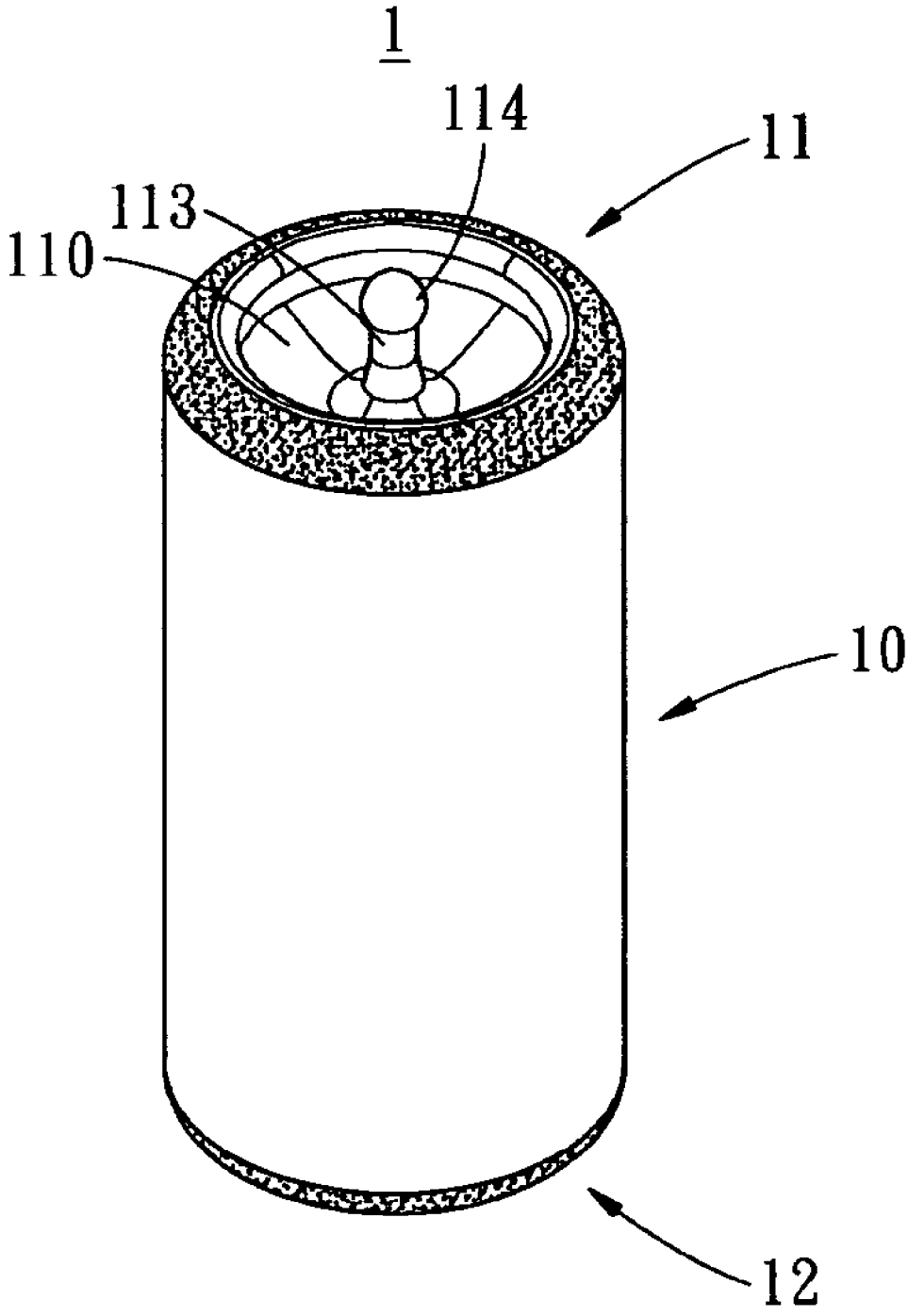
FIG. 6 shows a perspective view of the assembly as shown in FIG. 4.

As shown in FIGS. 3 to 5, the first and second lids 11 and 12 are interlocked with the pipe member 10 at the open ends 100 and 101, respectively. A welding process is applied. As the thickness b of the flanges 112 and 122 is not larger than the thickness B of the pipe member 10 at the open ends 100 and 101, the flanges 112 and 122 are melted first, and the melted portions of the flanges 112 and 122 are more than that of the wall of the pipe member 10. Therefore, the wall (side surface) of the pipe member 10 will not be damage due to fusion in the welding process. The flanges 112 and 122 do not provide axial positioning of the lids 11 and 12, but also serve as fusion region between the heat pipe 10 and the lids 11 and 12 to obtain a good welding effect. Thereby, the heat pipe can be fabricated by mass production with enhanced yield. Further, the end surfaces of the heat pipe will not protrude therefrom by sealing structure used to seal the heat pipe, such that the volume occupied by the inefficient portion of heat transfer is reduced. More thermal transfer members such as the fins 14 can thus be provided with the same volume.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. An end surface structure of a heat pipe, comprising:

a first lid having curved surface with a filing tube mounted thereon;

a second lid having curved surface; and a hollow pipe member with two opposing open ends and a wick structure attached to an interior sidewall thereof; wherein vibrating the container;

each of the first and second lids includes an interlocking member fitting frictionally to the interior wall at the open end of the hollow pipe where along a periphery thereof and a flange extending radially and outwardly from the interlocking member coupling tightly and peripherally with the radial surface of a sidewall at the corresponding open end of the pipe member, while the flanges have a thickness smaller than that of the sidewall of the pipe member.

2. The structure as claimed in claim 1, wherein the hollow pipe member includes a cylindrical pipe.

3. The structure as claimed in claim 1, wherein the first lid comprises a filling tube mounted thereon.

4. The structure as claimed in claim 1, wherein filling tube includes a sealing portion.

5. The structure as claimed in claim 1, wherein the first and second lids are formed by press process.

6. The structure as claimed in claim 1, wherein the curved surfaces include recessed surfaces.

7. The structure as claimed in claim 1, wherein the curved surfaces include protruding surfaces.

8. The structure as claimed in claim 1, wherein the flanges have peripheries larger than an internal periphery of the open ends.

9. The structure as claimed in claim 8, wherein the flanges have peripheries no larger than an external periphery of the heat pipe.

* * * * *